US012767282B2

(12) United States Patent
Millar

(10) Patent No.: US 12,767,282 B2
(45) Date of Patent: Oct. 20, 2026

(54) MEANS FOR REMOVABLY INSTALLING FINS ON A BOARD FOR USE IN WATER SPORTS

(71) Applicant: Future Fins, LLC, Huntington Beach, CA (US)

(72) Inventor: Russell John Millar, Wellington (NZ)

(73) Assignee: FUTURES FINS, LLC, Huntington Beach, CA (US)

( * ) Notice: Subject to any disclaimer, the term of this patent is extended or adjusted under 35 U.S.C. 154(b) by 406 days.

(21) Appl. No.: 18/560,190

(22) PCT Filed: May 11, 2022

(86) PCT No.: PCT/NZ2022/050056
§ 371 (c)(1),
(2) Date: Nov. 10, 2023

(87) PCT Pub. No.: WO2022/240301
PCT Pub. Date: Nov. 17, 2022

(65) Prior Publication Data

US 2024/0217627 A1 Jul. 4, 2024

(30) Foreign Application Priority Data

May 13, 2021 (NZ) ..... 776015

(51) Int. Cl.
*B63B 32/66* (2020.01)

(52) U.S. Cl.
CPC ..... *B63B 32/66* (2020.02)

(58) Field of Classification Search
CPC ..... B63B 32/66
See application file for complete search history.

(56) References Cited

U.S. PATENT DOCUMENTS

2003/0087564 A1* 5/2003 Kelley ..... B63B 32/66 441/74
2006/0035543 A1* 2/2006 English ..... B63B 32/66 114/140
2017/0158294 A1* 6/2017 Watson ..... B63B 32/66

FOREIGN PATENT DOCUMENTS

CN 106043615 10/2016
DE 3307412 9/1984
WO WO2021118370 6/2021

OTHER PUBLICATIONS

Balzer, Ralf, Written Opinion of International Search Report; Oct. 4, 2022; 9 pages, Rijswijk.

* cited by examiner

*Primary Examiner* — Andrew Polay
(74) *Attorney, Agent, or Firm* — STETINA GARRED BRUCKER & NEWBOLES

(57) ABSTRACT

A mount for removably installing a fin to a board used in water sports. The mount is secured within the deck of the board and has a cam including a pivoting member pivoting between a locking position, to lock a fin to the board, to an unlocked position where the fin can be removed from the board, under hand pressure. The pivoting member pivots about a pivot pin under the biasing pressure of spring. In the locking position lug engages with its complementary recess in the distal end of the base of fin and the fin is then locked in the mount. In the unlocking operation downward finger pressure on surface causes pivoting member to rotate, overcoming the strength of the spring, causing lug to disengage from recess and allow fin to be rotated about its butt end and be removed from the mount.

8 Claims, 3 Drawing Sheets

MEANS FOR REMOVABLY INSTALLING FINS ON A BOARD FOR USE IN WATER SPORTS

CROSS-REFERENCE TO RELATED APPLICATIONS

The present application claims priority to PCT International Patent Application No. PCT/NZ2022/050056, filed May 11, 2022, and New Zealand Patent Application No. 776015, filed on May 13, 2021, the disclosures of which are incorporated herein by reference.

STATEMENT RE: FEDERALLY SPONSORED RESEARCH/DEVELOPMENT

Not Applicable

BACKGROUND

Field of Invention

This invention relates to means for removably installing fins to a board used in water sports such as surfboards, wake boards, wind surfers, motorised boards and stand-up paddle boards.

Background

It is known for the tail end of such boards such as a surfboard to have one or more fins. The description in this specification will generally refer to surfboards but it is to be understood that the discussion of any point will also apply to the other boards envisaged by this invention.

Each fin may serve as a hydrofoil to improve stability and control as a surfer steers the board through the water. Surfboards are sometimes supplied without fins, with the intention that the fins will be purchased separately and retrofitted. Also, over time fitted fins can become damaged, for example when surfing or transporting surfboards, and need replacement. It is also possible that fins can detach during conditions of adverse use, such as by coming into contact with the ground during surfing such that a fin will detach involuntarily. And, in some cases, it is desirable to change the size or style of fin used depending on wave conditions. Fitting or replacing fins can be problematic in that the process may require the application of significant force or the use of tools.

OBJECT OF THE INVENTION

It is an object of preferred forms of the invention to go at least some way towards addressing the above problems. While this applies to at least preferred forms it should be understood that the object of the invention per se is simply to provide a useful choice. Therefore, any benefits or advantages applicable to a preferred embodiment should not be read-in as a limitation on any claims expressed more broadly.

INTERPRETATION

The term "comprising" or related terms such as "comprises" should not be interpreted exclusively. They indicate the minimum features present without ruling out the option of there being further unspecified features. The "features" may for example be physical parts and/or action steps.

SUMMARY OF THE INVENTION

In accordance with this invention there is provided a board for use in water sports comprising,

- a fin and a deck, the fin being removably secured to the deck by a fin mount secured within a cavity in the deck,
- the fin mount being configured to receive the base part of the fin in a releasably secure fit,
- a butt end of the base of the fin engaging with the mount in a releasable and rotatable fit, the distal end of the base of the fin engaging with a cam that forms part of the mount, the cam having a contact area for application of downward finger pressure,
- the fin, when its butt end part is engaged rotatably in the mount, being rotatable to a position where the distal end part engages with the cam to lock the fin in the mount,
- the cam including a pivoting member biased by a biasing member to a position to engage with the distal end of the fin, as the fin is rotated to a position within the mount, to lock
- the distal end of the fin to the pivoting member to secure the fin to the mount and where downward finger pressure applied to the contact area of the cam disengages the pivoting member from the distal end of the fin so that the fin can be removed from the mount.

The fin mount will be of a size and shape to fit within the cavities in the board. The cavities are normally provided at the time of manufacture. The cavities can vary in size and shape. The fin mount can be manufactured in various sizes and shapes to match the size and shape of each different cavity. Some sizes and shapes are more common than others.

This invention will be described by way of example with reference to a fin mount for inserting into a cavity in a board the cavity having what might be termed a "racetrack shape" that is having substantially parallel sides and rounded ends.

Optionally the mount has a shape to conform with a cavity in the board having parallel sides, and optionally rounded ends which may be termed a classical "racetrack shape". In such an embodiment the width of the cavity restricts the width of the mount. Optionally the mount can be used with other cavities by the use of additional packing around the mount to fill any gaps that exist between the mount and the cavity. This might require additional resin to ensure the mount is securely fixed within the cavity.

By finger pressure is meant that one or more fingers (which includes a thumb) can, by manual force applied to the cam, pivot the pivoting member to move from its position locking the fin, to a position where the fin can be released from the mount. While the invention provides a system that allows such a simple operation, with some individuals the force needed to pivot the pivoting member might not be achievable and the invention recognises that in some circumstances a tool may be used to assist in that action. By the invention the force generated by downward finger pressure can be selected, such as by varying the size of the finger contact area on the cam and the strength of the spring, to ensure that most individuals can provide sufficient force to pivot the pivoting member.

The pivoting member pivots between two positions. A first locking position and a second unlocking position. The pivoting member is driven to the locking position by the force of a biasing member, such as a resilient member (for example a steel spring), operable between a position on the mount and a position on the pivoting member. The pivoting member is moved to its unlocking position by sufficient finger pressure on the cam overcoming the force exerted on the pivoting member by the biasing member. The strength of the biasing member needs to be selected to ensure the pivoting member, by finger pressure, moves to the unlocking position while ensuring the strength is sufficient to carry out its locking function when in the locking position.

Optionally the pivoting member is pivotable about a pin such that it moves when contacted by the lower portion of the distal end of the fin as the fin is manually rotated anticlockwise allowing the distal end bottom portion to ride over the end of the pivoting member against the force of the biasing member and to allow the end of the pivoting member to snap back under the force of the biasing member to interlock with a complementary shape in the end of the fin to securely lock the fin in place in the mount.

Optionally the pivoting member has a shaped portion such as a lug at its distal end which engages with a complementary recess in the distal end of the fin.

Optionally the lug and recess are shaped to permit the bottom portion of the distal end of the fin to ride smoothly over the end of the lug and to lock together to securely hold the fin in the mount in the locked position while allowing the lug to disengage from the recess when the lug moves under finger pressure applied to the cam.

Optionally the biasing member is a steel spring of a strength to provide a secure lock of the lug in the recess while permitting the downward finger pressure on the cam to force the lug to disengage from the recess.

The invention also includes a fin mount as discussed above configured to receive a fin and a board manufactured with such a mount securely fixed within the cavity of the board.

BRIEF DESCRIPTION OF THE DRAWINGS

These and other features and advantages of the various embodiments disclosed herein will be better understood with respect to the following description and drawings, in which like numbers refer to like parts throughout, and in which.

Some embodiments of the invention will now be described by way of example with reference to the accompanying drawings in which.

DETAILED DESCRIPTION

Figure 1:
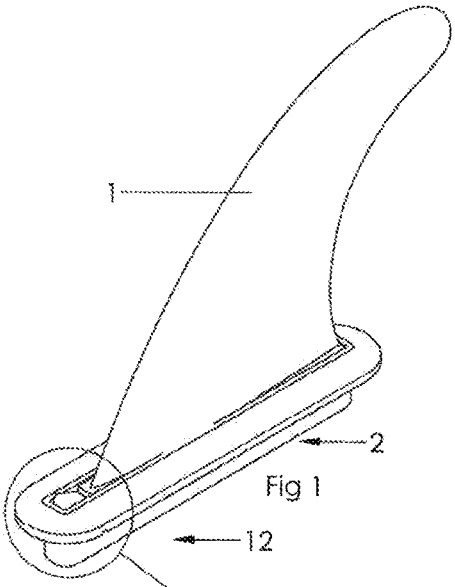
FIG. 1 is a perspective view of a standard fin in a position where it can be released from an embodiment of a mount of this invention.
Figure 2:
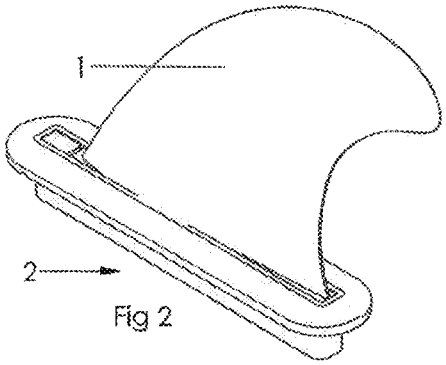
FIG. 2 is a perspective view of a standard fin locked within the mount of this invention shown in FIG. 1.
Figure 3:
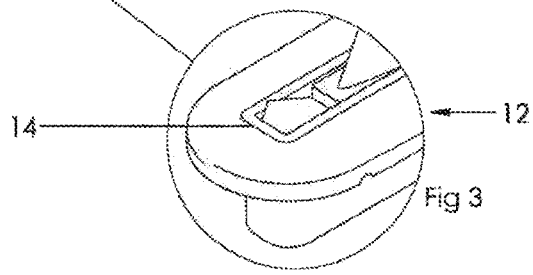
FIG. 3 is an expanded view of part of the end of the mount shown in FIG. 1.

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combination described herein. Thus, the scope of the claims is not to be limited by the illustrated embodiments.

Referring to the drawings a standard fin 1 is releasably secured within a mount indicated by arrow 2.

The fin mount is secured within a cavity in a board (not shown) by conventional means such as bonding with a suitable resin.

The board of the invention is for water sport use such as a surfboard, a stand-up paddle board, a wake board, windsurfing board or a motorised board. The following description will focus on surfboards but it will be clear that the embodiments described can readily be used for other water sport boards.

The cavity in the board is usually formed when the board is manufactured. Each manufacturer may provide a different shaped and depth cavity. A common cavity is what may be termed a "racetrack shape" with parallel sides and rounded ends. The embodiments described in the attached drawings are designed to fit into such a cavity and be secured by suitable resins. The invention is not limited to a fin mount with a matching racetrack shape or to be used in a cavity of such a shape. Deviations between the shape of the cavity and the outer shape of the mount can be accommodated such as by packing and use of more resins. Normally a manufacturer will want a shape and size of a mount that is close to that of the cavity to minimise the amount of resin required and to ensure that the mount is secured within the cavity.

At a butt end 3 of the fin 1 (FIG. 4), normally the rear end, the fin is releasably and rotatably attached to the mount. The various relative positions and directions in this specification refer to the mount and fin being viewed as in FIGS. 1, 2, 4 and 5 with the butt end at the right-hand end of the drawing and the cam at the distal end at the left hand end of the drawing. Anticlockwise or clockwise motion is described with reference to the same view.

Figure 4:
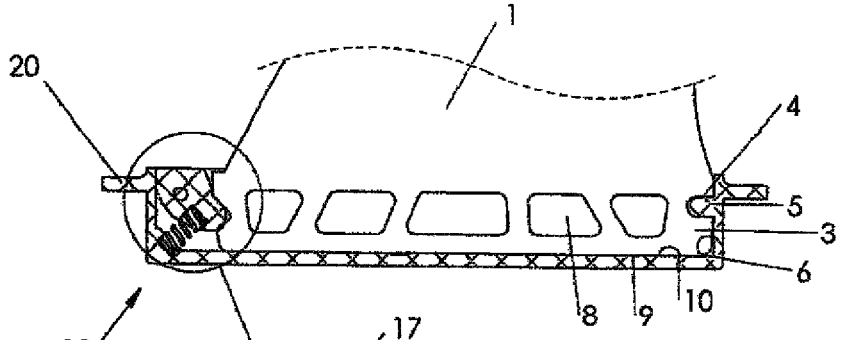
FIG. 4 is a cross-section of the embodiment of the mount shown in FIGS. 2 and 6 along the line A-A in FIG. 6.
Figure 9:
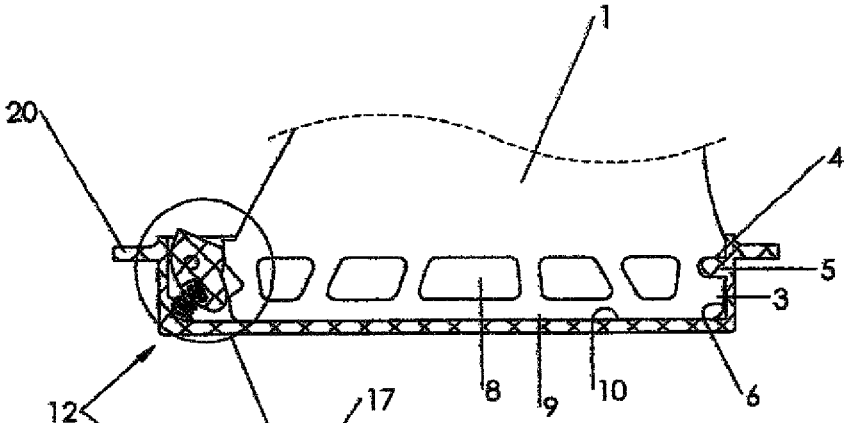
FIG. 9 is a cross-section of the embodiment of the invention shown in FIG. 1, in which the fin is in a position to be released from the mount.

As shown in FIGS. 4 and 9 a groove 4 is provided in the end 3 of the fin 1 to engage releasably and rotatably with a tongue 5 protruding from the rear surface 6 of the channel 11 (FIG. 6) in the mount. When the fin 1 is disengaged from the cam as discussed below it can be manually rotated in a clockwise direction and then disengaged from the tongue 5 and thus released from the mount and board when required.

The fin 1 has a series of openings 8 to reduce the weight of the fin while still retaining adequate strength to perform its function. The fin 1 is in the locked position in FIG. 4 with its base 9 resting on the floor 10 in the channel 11 (FIG. 5) within the mount 2.

Figure 5:
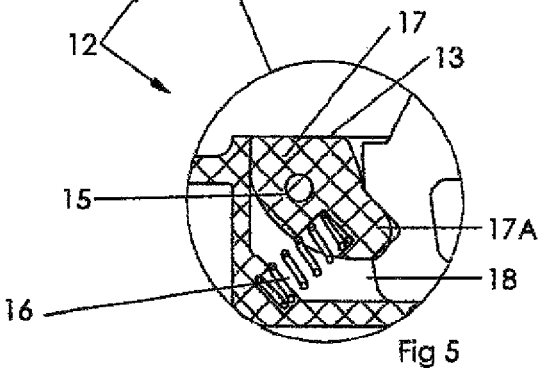
FIG. 5 is an expanded view of part of the end of the mount shown in FIG. 4.
Figure 10:
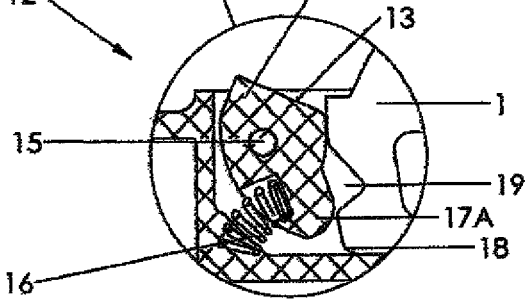
FIG. 10 is an expanded view of the end of the mount shown in FIG. 9.

In the drawings, particularly FIGS. 5 and 10 the cam is generally indicated by arrow 12, having an upper surface 13 for application of finger pressure. The cam surface can be set substantially within the planar surface of a raised surround 14 of the channel 11, when the cam is in position to lock the fin in place. The perimeter of the surround is of a streamlined shape so water flows smoothly over the board when in use. A suitable shape is a radiused vertical surface. The rear part of the upper surface 13 of the cam is of a size to permit a user to apply finger pressure to it to cause the cam to rotate about a pivot point such as a pin 15. The finger pressure is in a downwards direction relative to the mount when the device is in the disposition shown in the drawings.

The cam in this embodiment has a pivoting member 17 integrally formed with a downwardly depending lug 17A.

The lug 17A is shaped to engage with a complementary shape such as a recess 19 in the distal edge 18 of the fin 1 upon downward finger pressure being applied to the rear part of the upper surface 13 of the cam 12. The pivoting member 17 is biased by a steel spring 16 to the locking position shown in FIGS. 4 and 5.

One end of the spring can be fixed within a suitable recess in the pivoting member 17. The other end of the spring is fixed to the mount as shown in FIGS. 5 and 10.

The shape of the lug and recess needs to allow the bottom portion of the distal end 18 of the fin 1 to smoothly ride over the upper surface of the end of the lug 17A as the fin is manually rotated anticlockwise towards its locked position. As the fin further rotates the end of the lug 17A moves into correct alignment with the recess 18. The spring 16 then forces the end of the lug into the recess 18 to securely lock the fin to the mount.

The shape of the lug 17A and the recess 19 needs to allow the end of the lug 17A to clear the recess 18 when moving from the locking to the unlocking position to allow the end of the fin to be freely rotated clockwise to escape the lug thus allowing the fin 1 to be removed from the mount. Sufficient downward finger pressure on the rear part of the cam surface 13 forces the pivoting member 17 to rotate in a clockwise direction against the force of the spring for lug 17A to move to the unlocking position shown in FIGS. 9 and 10.

Figure 8:
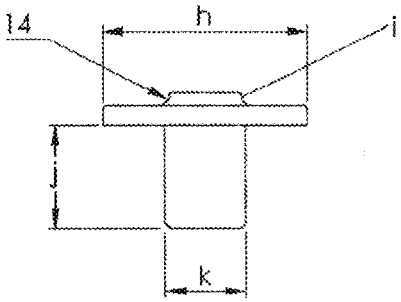
FIGS. 7 and 8 are side and end elevations of the embodiment shown in FIG. 2.
Figure 6:
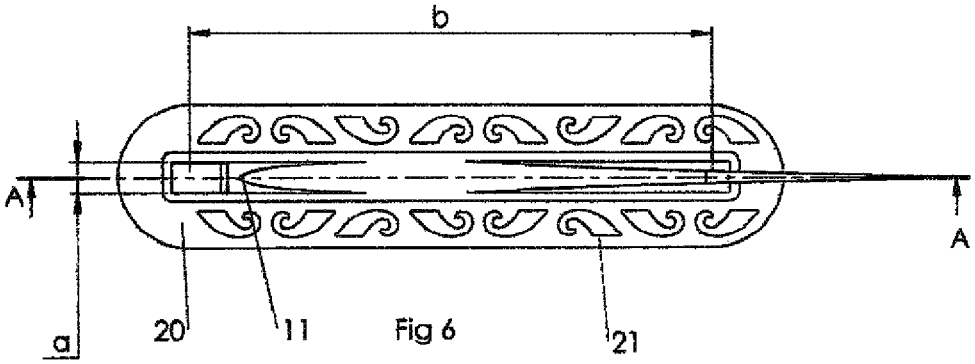
FIG. 6 is a plan view of the embodiment of the invention shown in FIG. 1 with graphics on its upper surface.
Figure 7:
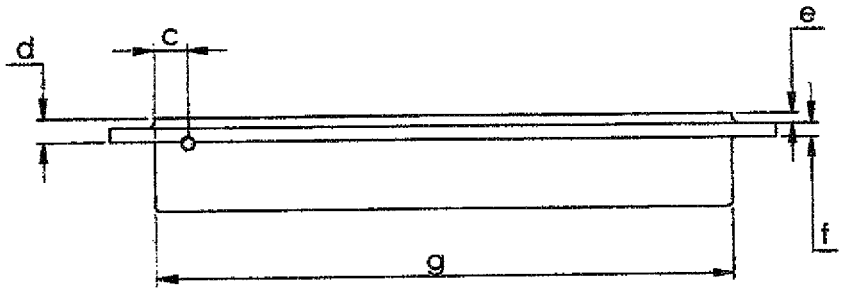

The mount of the invention can be manufactured in any desired size. The dimensions shown below with reference to FIGS. 6 to 8 are those of mount for use in a thicker board. With a common thinner board the depth dimension "d" is simply reduced while retaining the other dimensions as shown below.

The mount can be manufactured from any suitably strong materials such as by injection moulding using conventional methods.

To exemplify one particular fin mount, the dimensions (mm) of the device shown in FIGS. 6 to 8 can be as follows:

$$a = 71.5,\ b = 150.0,\ c = 7.5,\ d = 5.7,\ e = 2.2,\ f = 3.0,$$

$$g = 130.0,\ h = 32.0,\ i = R2.0,\ j = 16.0 \text{ and } k = 12.5.$$

These dimensions are given to illustrate suitable dimensions of one device of the invention but different devices within the scope of the broad embodiments of the invention can and will have different values to those set forth above.

While this invention has been described with reference to particular embodiments it is not to be construed as limited thereto. Furthermore where known equivalents exist to specific features or constructional steps such equivalents are included herein as if specifically set forth.

The invention claimed is:

1. A board for use in water sports comprising:

a fin and a deck, the fin being removably secured to the deck by a fin mount secured within a cavity in the deck;

the fin mount being configured to receive the base part of the fin in a releasably secure fit;

a butt end of the base of the fin engaging with the mount in a releasable and rotatable fit;

the distal end part of the fin engaging with a cam that forms part of the mount, the cam having a contact area for application of downward finger pressure;

the fin, when its butt end part is engaged rotatably in the mount, being rotatable to a position where the distal end part engages with the cam to lock the fin in the mount; and the cam including a pivoting member biased by a biasing member to a position to engage with the distal end of the fin, as the fin is rotated to a position within the mount, to lock the distal end of the fin to the pivoting member to secure the fin to the mount and where downward finger pressure applied to the contact area of the cam disengages the pivoting member from the distal end of the fin so that the fin can be removed from the mount, the pivoting member being configured to pivot between a first locking position and a second unlocking position, the pivoting member being driven to the locking position by the force of the biasing member, the biasing member being a spring.

2. A board of claim 1 wherein the biassing member is a steel spring.

3. A board of claim 1 wherein the force of the biasing member holding the pivoting member in the locked position is overcome by downward finger pressure on the pivoting member to move the pivoting member to the unlocked position.

4. A board of claim 1 wherein the pivoting member pivots on a pin to move between the locking and unlocking positions.

5. A board of claim 1 wherein the fin is manually rotatable about its butt end connection to the mount so that the distal end portion of the base of the fin moves toward the cam and rides over a shaped end portion of a downwardly depending portion of the pivotable member such that the shaped end portion engages with a complementary shape in the distal end of the fin and is held there by the biasing member to lock the pivoting member to the fin.

6. A board of claim 1 wherein the pivoting member has a shaped portion in the form a lug at its distal end which engages with a complementary recess in the distal end of the fin.

7. A board of claim 1 wherein the lug and recess are shaped to permit the bottom portion of the distal end of the fin to ride smoothly over the end of the lug to allow the lug to engage with the recess and to lock together to securely hold the fin in the mount in the locked position while allowing the lug to disengage from the recess when the lug moves under finger pressure applied to the pivoting member and allow the fin to be removable from the mount.

8. A board of claim 1 wherein the fin mount is secured in a cavity in the deck of the board manufactured and sold separately from any fins.

* * * * *